US007011534B2

(12) United States Patent
Shen

(10) Patent No.: US 7,011,534 B2
(45) Date of Patent: Mar. 14, 2006

(54) TRACK ADAPTER AND TRACK LIGHT KIT EQUIPPED WITH THE SAME

(76) Inventor: Wei Hong Shen, 6F, No. 649-9, Chung Cheng Rd., Hsinchuang City, Taipei Hsien (TW)

( * ) Notice: Subject to any disclaimer, the term of this patent is extended or adjusted under 35 U.S.C. 154(b) by 14 days.

(21) Appl. No.: 10/833,019

(22) Filed: Apr. 28, 2004

(65) Prior Publication Data

US 2005/0245112 A1 Nov. 3, 2005

(51) Int. Cl.
*H01R 25/00* (2006.01)

(52) U.S. Cl. ..... 439/119; 439/121; 439/116

(58) Field of Classification Search ..... 439/121, 439/122, 700, 824, 116, 117, 1, 119, 115; 362/418, 422, 431, 640, 648

See application file for complete search history.

(56) References Cited

U.S. PATENT DOCUMENTS 4,776,809 A * 10/1988 Hall ..... 439/121
4,919,625 A * 4/1990 Coutre ..... 439/118
5,110,300 A * 5/1992 Woodgate ..... 439/121

* cited by examiner

*Primary Examiner*—Tho D. Ta
*Assistant Examiner*—Felix O. Figueroa
(74) *Attorney, Agent, or Firm*—Rosenberg, Klein & Lee

(57) ABSTRACT

A track adapter and a track light kit equipped with the same are is described. The track adapter is used for a track assembly and has an insulation tube, a resilient member, a press-in member, a mounting member, a conductive tube having a secure structure, and a connection assembly with a first electrode assembly and a second electrode assembly. The conductive tube and the first electrode assembly combine into a first electrical path; the press-in member, the resilient member, the mounting member and the second electrode assembly combine into a second electrical path. The track adapter can be mounted onto the track assembly easily due to the rotation of the secure structure of the conductive tube.

12 Claims, 7 Drawing Sheets

TRACK ADAPTER AND TRACK LIGHT KIT EQUIPPED WITH THE SAME

BACKGROUND OF THE INVENTION

1. Field of the Invention

The present invention relates to a track adapter, and particularly relates to a track adapter and a track light kit equipped with the same.

2. Background of the Invention

Track lights provide not only lighting but also decoration. Track lighting includes a track light assembly combined with the lamps and is widely used in various applications.

Referring to FIG. 1, a conventional track light 8 is mounted in a track assembly 9. The track light 8 includes two arms 80, and two clamping members 81 screwed to upper ends of the two arms 80, respectively. The track assembly 9 includes a track 900, two insulation strips 91 and two conductive strips 92. The track 900 has two clamping slots 93 formed on lateral sides thereof to engage with the two insulation strips 91, respectively. The two insulation strips 91 have passageways 94 accommodating the two conductive strips 92 clamped therein, respectively. The two clamping members 81 are connected to the conductive strips 92, respectively, as a connection between the track light 8 and the track assembly 9. A source can be applied to the track light 8 via the two conductive strips 92 and the two clamping members 81 consequently.

When the track light 8 is mounted in the track light 9, complicated steps are involved. The two clamping members 81 engage with the two conductive strips 92 first, and the two clamping members 81 are then secured by hand. This is a potentially difficult process in which objects may easily fall down, and the clamping members 81 and the arms 80 increase the weight of the track light 8.

Hence, an improvement over the prior art is required to overcome the disadvantages thereof.

SUMMARY OF INVENTION

The primary object of the invention is therefore to specify a track adapter and a track light kit equipped with the same to assemble a track light in a track assembly in an easy manner.

The secondary object of the invention is therefore to specify a track adapter and a track light kit equipped with the same to decrease the weight of the track light and shrink the volume thereof.

According to the invention, these objects are achieved by a track adapter and a track light kit equipped with the same. The track adapter is used for a track assembly and includes an insulation tube, a resilient member, a press-in member, a mounting member, a conductive tube having a secure structure, and a connection assembly including a first electrode assembly and a second electrode assembly. The insulation tube has an upper opening and a lower opening formed in two opposing ends thereof. The resilient member is made of conductive materials and arranged in the insulation tube. The press-in member is made of conductive materials, has a tail end contacting a head end of the resilient member, and is restricted in the insulation tube. The mounting member is made of conductive materials, has a head end contacting a tail end of the resilient member, and is orientated in the insulation tube. The conductive tube is made of conductive materials and has an upper entrance and a lower entrance formed in two ends thereof. The conductive tube includes a secure structure disposed on the upper entrance thereof, the insulation tube is disposed in the conductive tube, the press-in member has a head end exposed by the upper opening of the insulation tube and the upper entrance of the conductive tube, and the mounting member has a tail end exposed by the lower opening of the insulation tube and the lower entrance of the conductive tube. The connection assembly includes a first electrode assembly electrically connecting the conductive tube and a second electrode assembly electrically connecting the tail end of the mounting member.

According to the invention, these objects are achieved by a track adapter and a track light kit equipped with the same. The track light kit includes a track assembly and a track adapter. The track assembly includes a conductive track having a cutout and a clasp structure disposed on an inner wall thereof, an insulation strip arranged in the conductive track and having an opening relating to the cutout, and a conductive strip arranged in the insulation strip and exposed by the cutout. The track adapter is adopted for the track assembly and includes an insulation tube, a resilient member, a press-in member, a mounting member, a conductive tube having a secure structure, and a connection assembly including a first electrode assembly and a second electrode assembly. The insulation tube has an upper opening and a lower opening formed in two opposing ends thereof. The resilient member is made of conductive materials and arranged in the insulation tube. The press-in member is made of conductive materials, has a tail end contacting a head end of the resilient member, and is restricted in the insulation tube. The mounting member is made of conductive materials, has a head end contacting a tail end of the resilient member, and is orientated in the insulation tube. The conductive tube is made of conductive materials and has an upper entrance and a lower entrance formed in two ends thereof. The conductive tube includes a secure structure disposed on the upper entrance thereof, the insulation tube is disposed in the conductive tube, the press-in member has a head end exposed by the upper opening of the insulation tube and the upper entrance of the conductive tube, and the mounting member has a tail end exposed by the lower opening of the insulation tube and the lower entrance of the conductive tube. The connection assembly includes a first electrode assembly electrically connecting the conductive tube and a second electrode assembly electrically connecting the tail end of the mounting member.

The conductive tube and the first electrode assembly combine as a first electrical path; the press-in member, the resilient member, the mounting member and the second electrode assembly combine as a second electrical path. The track adapter can be mounted onto the track assembly easily due to the rotation of the secure structure of the conductive tube.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1:
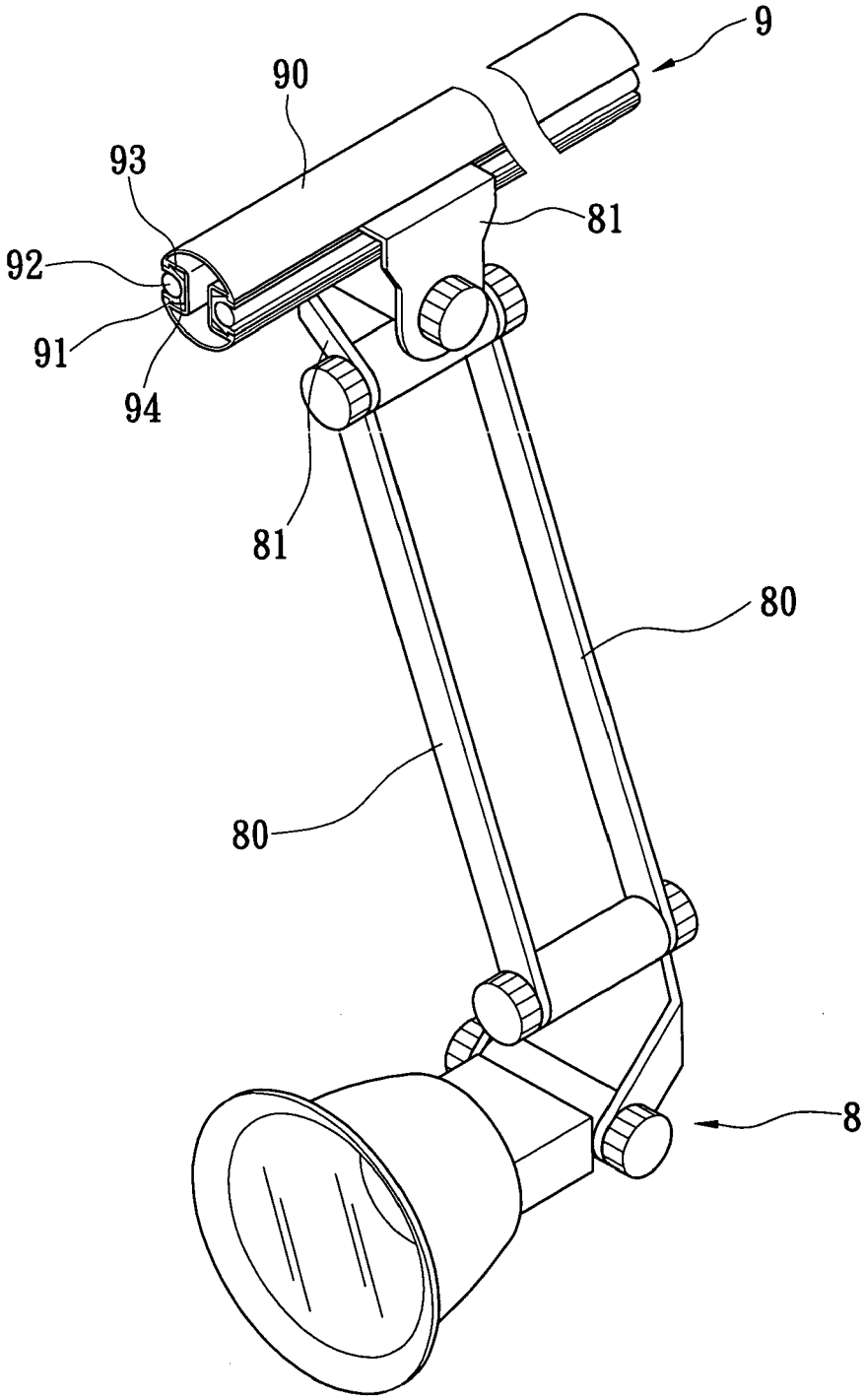
FIG. 1 PRIOR ART
FIG. 1 is a perspective view of a conventional track light mounted in a track assembly.
Figure 2:
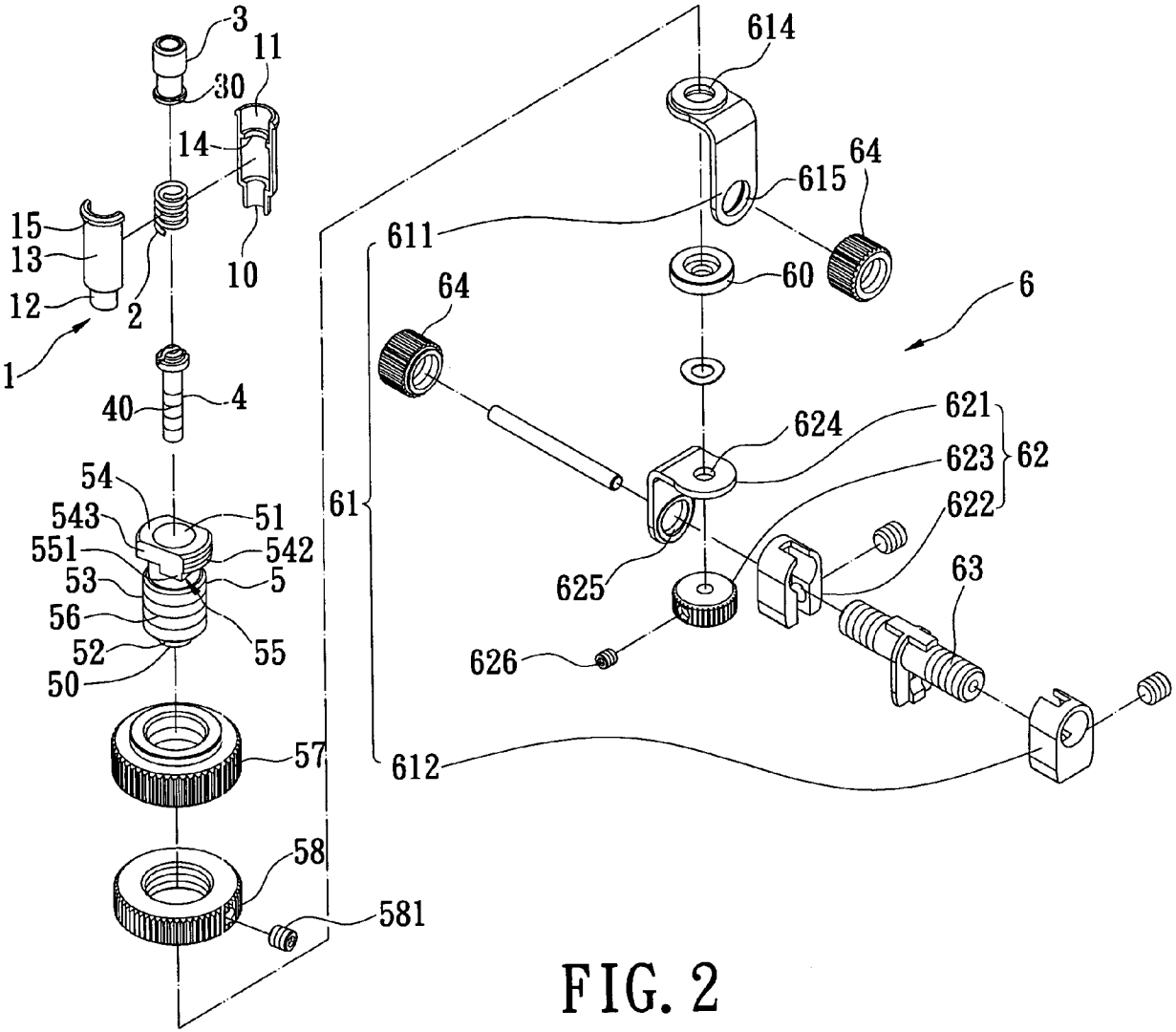
FIG. 2 is a decomposition view of a track adapter according to the present invention.
Figure 3:
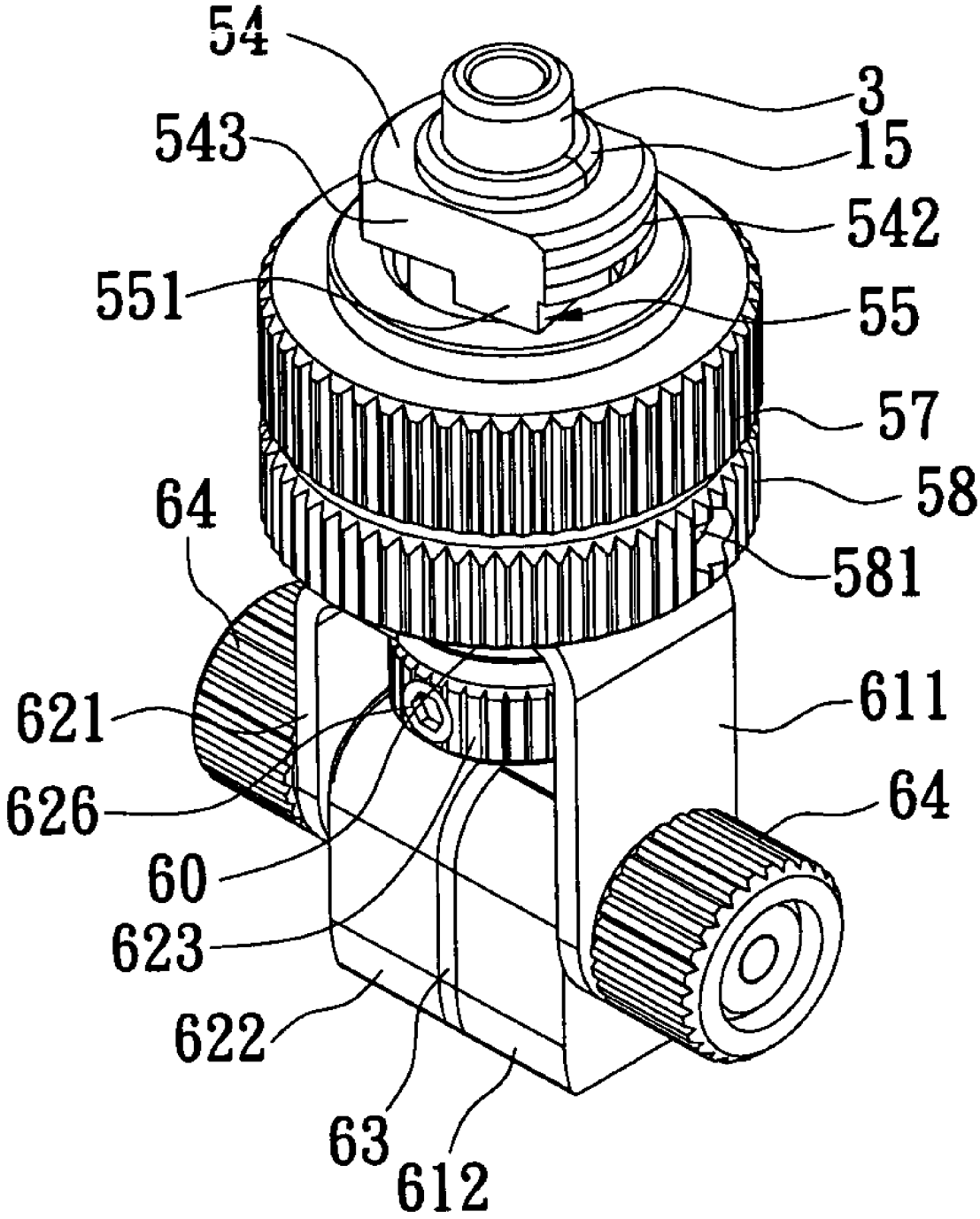
FIG. 3 is a perspective view of the track adapter according to the present invention.
Figure 5:
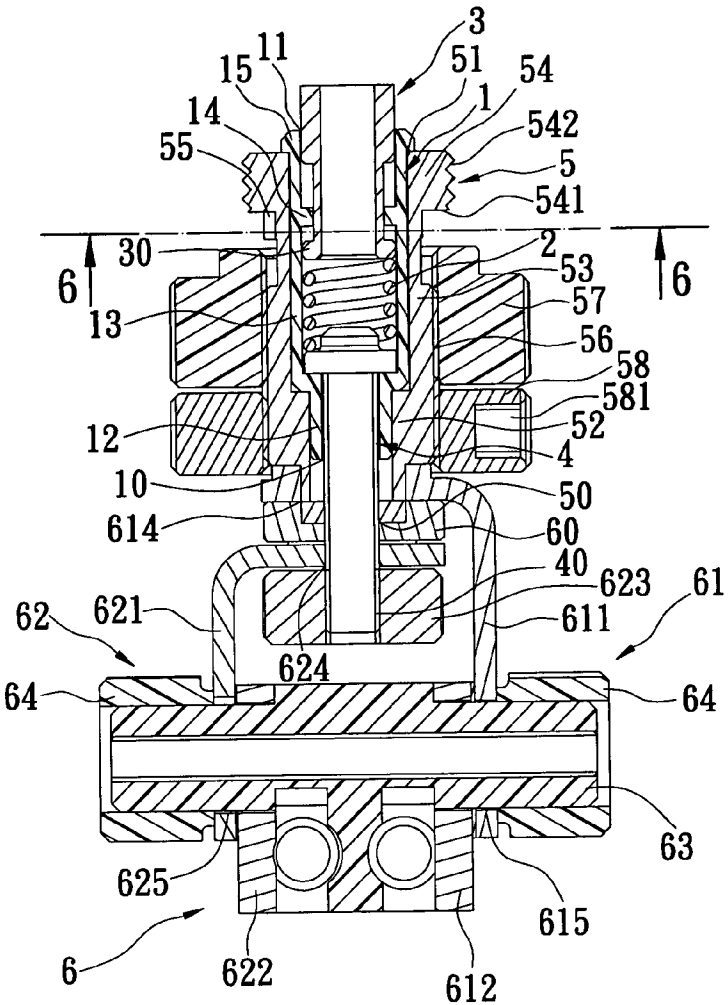
FIG. 5 is a cross-sectional view of the track adapter according to the present invention.
Figure 4:
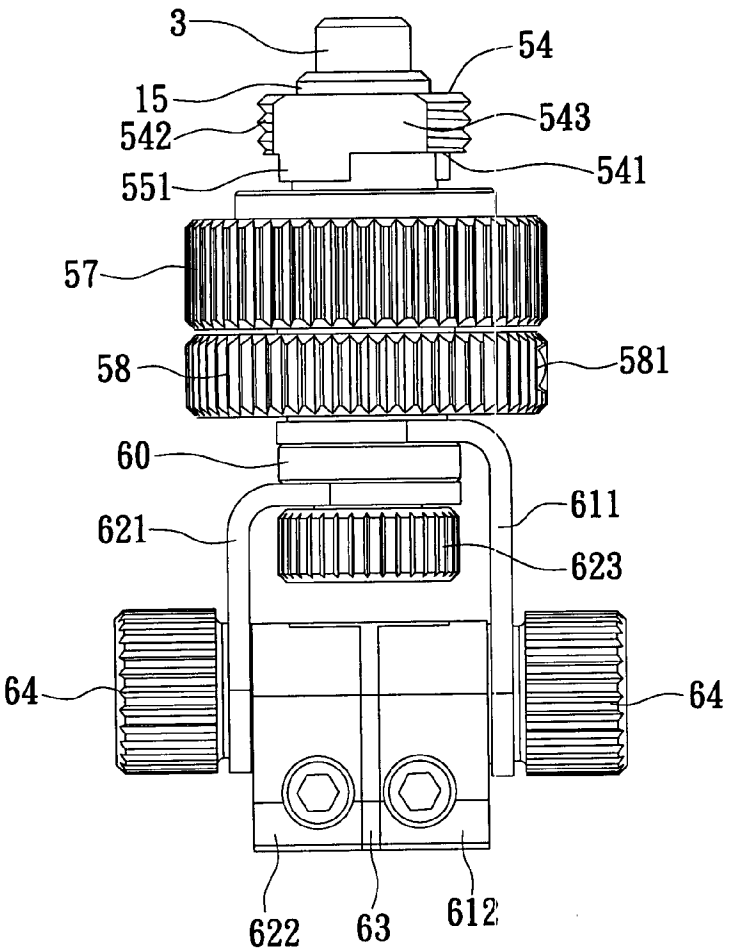
FIG. 4 is a side view of the track adapter according to the present invention.

With respect to FIGS. 2 to 5, the present invention provides a track adapter used for a track assembly and includes an insulation tube 1, a resilient member 2, a press-in member 3, a mounting member 4, a conductive tube 5, and a connection assembly 6.

The insulation tube 1 has an upper opening 11 and a lower opening 10 formed in two opposing ends thereof. Two semi-circular cylinders are combined to make the insulation tube 1. The insulation tube 1 has an upper portion 13 and a lower portion 12. The lower portion 12 has an inner diameter and an outer diameter less than those of the upper portion 13. The insulation tube 1 has an interior flange 14 formed thereon and adjacent to the upper opening 13 thereof, and an exterior flange 15 formed thereon and adjacent to the upper opening 13 thereof.

The resilient member 2 is made of conductive materials and arranged in the insulation tube 1.

The press-in member 3 is made of conductive materials and is cylindrical in shape. The press-in member 3 has an exterior flange 30 formed thereon and adjacent to a tail end thereof, and the press-in member 3 is restricted in the insulation tube 1 because the interior flange 14 of the insulation tube 1 barricades the exterior flange 30 of the press-in member 3.

The mounting member 4 is made of conductive materials, and has a head end contacting a tail end of the resilient member 2 to orientate in the insulation tube 1. The mounting member 4 has a screw thread 40 arranged on the tail end thereof.

Figure 6:
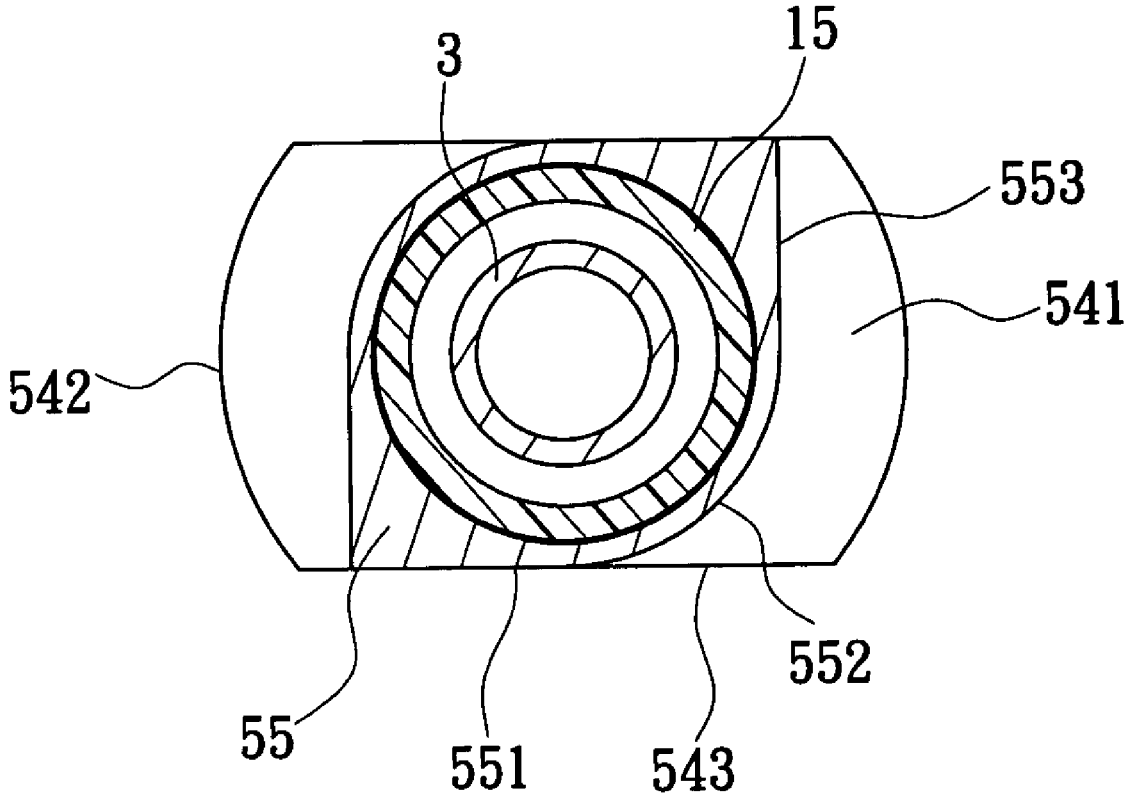
FIG. 6 is an enlarged cross-sectional view according to a line 6—6 of the present invention.

The conductive tube 5 is made of conductive materials and has an upper entrance 51 and a lower entrance 50 formed in two ends thereof. The conductive tube 5 has a top portion 53 and a bottom portion 52, and the bottom portion 52 has an inner diameter less than that of the top portion 53. The upper portion 53 of the insulation tube 1 mates with the top portion 53 of the conductive tube 5. Referring to FIG. 6, the secure structure in this embodiment is a bump 54 projecting therefrom; the bump 54 is disposed in the top portion 53 and adjacent to the upper entrance 51. The bump 54 is rectangular in shape; the bump 54 has two screw surfaces 542 opposing each other and two flat surfaces 543 opposing each other formed outwardly. The two screw surfaces 542 are separated from each other by a distance longer than that separating the two flat surfaces 543. The bump 54 has a contact surface 541 opposing the upper entrance 51 of the conductive tube 5; the conductive tube 5 includes a baffle portion 55 connecting the contact surface 541. The baffle portion 55 has two strengthening surfaces 551 opposing each other, two rounded surfaces 552 opposing each other, and two baffle surfaces 553 opposing each other. The two strengthening surfaces 551 and the two flat surfaces 543 are coplanar, respectively; the two baffle surfaces 553 are adjacent to the contact surface 541; and the rounded surfaces 552 are adjacent to the contact surface 541 and located between the two baffle surfaces 553 and the two strengthening surfaces 551, respectively. The insulation tube 1 is disposed in the conductive tube 5, the lower portion 12 of the insulation 1 mates with the bottom portion 52 of the conductive tube 5, and the upper portion 13 of the insulation tube 1 mates with the top portion 53 of the conductive tube 5. The upper portion 13 of the insulation tube 1 is exposed by the upper entrance 51 of the conductive tube 5, and the exterior flange 15 of the insulation tube 1 has an exterior diameter lager than an interior diameter of the upper entrance 51 of the conductive tube 5. The press-in member 3 has a head end exposed by the upper opening 11 of the insulation tube 1 and the upper entrance 51 of the conductive tube 5, and the mounting member 4 has a tail end exposed by the lower opening 10 of the insulation tube 1 and the lower entrance 50 of the conductive tube 5. The track adapter further includes a secure member 57, a rotation member 58 and a connection member 581. The conductive tube 5 includes a screw thread 56 arranged thereon, the secure member 57 and the rotation member 58 are screwed onto the conductive tube 5 via the screw 57, and the connection member 581 penetrates through to orientate the rotation member 58 in the conductive tube 5.

The connection assembly 6 is varied according to the type of a track light. In the embodiment, the connection assembly 6 includes an insulation sheet 60, a first electrode assembly 61 electrically connecting the conductive tube 5, a second electrode assembly 62 electrically connecting the tail end of the mounting member 4, an insulation post 63, and two screw nuts 64. The first electrode assembly 61 includes a first arm 611 made of conductive materials in an L shape, and a first junction 612 made of conductive materials and connecting an end of the insulation post 63. The first arm 611 has an upper through hole 614 and a lower through hole 615 formed in two opposing ends thereof. The second electrode assembly 62 includes a second arm 621 made conductive materials and in an L shape, a second conjunction 622 made of conductive materials connecting an opposing end of the insulation post 63, a screw nut 623 and an orientation member 626. The second arm 621 has a top through hole 624 formed thereon and a bottom through hole 625 formed on two opposing ends thereof. The first conjunction 612 and the second conjunction 622 connect the two ends of the insulation post 63, respectively. The lower through hole 615 of the first arm 611 and the bottom through hole 625 of the second arm 621 accommodate the two ends of the insulation post 63, respectively, and contact the first conjunction 612 and the second conjunction 622, respectively. The two screw nuts 64 screw the two ends of the insulation post 63 and outside the first arm 611 and the second arm 621, respectively. The head end of the first arm 611 is arranged on the lower entrance 50 of the conductive tube 5. The tail end of the mounting member 4 penetrates through the upper through hole 614 of the first arm 611, the insulation sheet 60 and the top through hole 624 of the second arm 621 to screw into the screw nut 623 of the second electrode assembly 62. The orientation member 626 penetrates through the screw nut 623 to mate with the screw thread 40 of the mounting member 4. The first conjunction 612 and the second conjunction 622 are assembled with a bulb 65 of the track light.

The first electrode assembly 61 connects the conductive tube 5, and the second electrode assembly 62 connects the tail end of the mounting member 4. The conductive tube 5 and the first electrode assembly 61 combine into a first electrical path; the press-in member 3, the resilient member 2, the mounting 4 member and the second electrode assembly 62 combine into a second electrical path.

Figure 7:
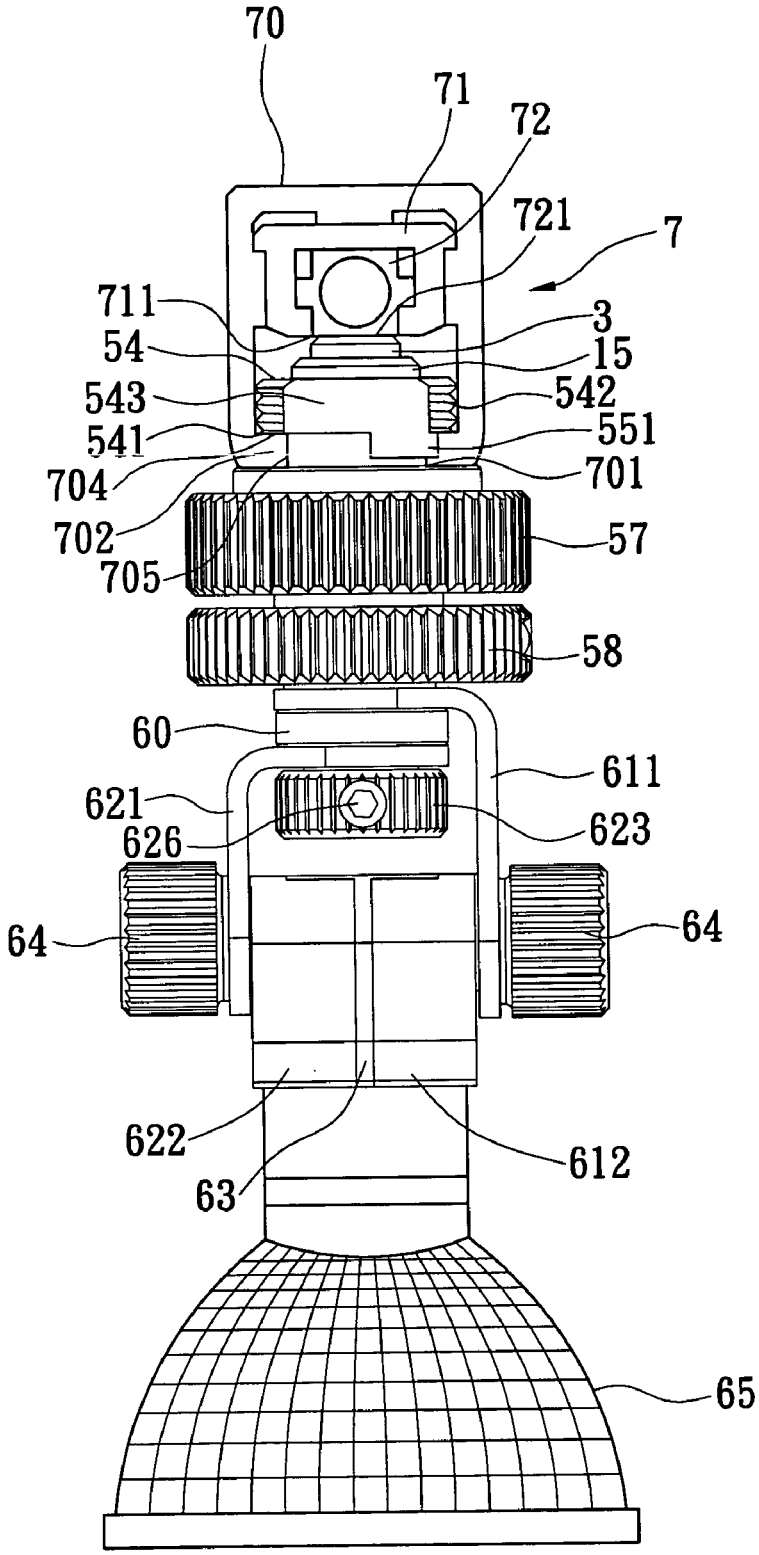
FIG. 7 is a side view of a track light kit according to the present invention.

With respect to FIG. 7, another embodiment of the present invention, a track light kit includes a track assembly 7 and the track adapter mentioned above. The track assembly 7 includes a conductive track 70 having a cutout 701 and a clasp structure disposed on an inner wall thereof, an insulation strip arranged in the conductive track 70 and having an opening 711 relating to the cutout 701, and a conductive strip 72 arranged in the insulation strip 71 and exposed by the cutout 701. The cutout 701 is less than the distance between the two screw surfaces 542 and larger than the distance between the flat surfaces 543. The clasp structure is two opposing blocks 702, each having a first conductive surface 704 and two side-baffle surfaces 705. The cutout 701 is between the two side-baffle surfaces 705. The conductive strip 72 includes a second conductive surface 721 exposed by the opening 711.

When the track assembly 7 is assembled, the bump 54 of the conductive tube 5 of the track adapter is accommodated by the cutout 701 thereof, and the head end of the press-in member 3 electrically connects the second conductive surface 721 of the conductive strip 72 via the cutout 701 of the conductive track 70 and the opening 711 of the insulation strip 71. The resilient member 2 then retains the press-in member 3 against the conductive strip 72. The rotation member 58 is rotated with a right angle to rotate the conductive tube 5, and the baffle surface 553 of the baffle portion 55 of the conductive tube 5 abuts against the side-baffle surface 705 of the block 702 of the conductive track 70 thereby. The bump 54 of the conductive tube 5 electrically connects the first conductive surface 704 of the block 702 of the conductive track 70 via the contact surface 541 thereof. The secure member 57 is rotated for further security between the contact surface 541 and the first conductive surface 704 and to avoid the looseness of the resilient member 2. Therefore, the track adapter connects to the track assembly 7 easily due to the rotation of the secure structure of the conductive tube 5. The conductive track 70 and the conductive strip 72 electrically connect the first electrical path and the second electrical path, respectively.

When the track light is removed, the secure member 57 is reversed to release the same; the contact surface 541 of the conductive tube 5 removes the first conductive surface 704 of the conductive track 70. The rotation member 58 is reversed with a right angle; the resilient member 2 provides a recovery force for the strengthening surface 551 of the baffle portion 55 of the conductive tube 5 contacting the side-baffle surface 705 of the block 702 of the conductive track 70. Thus, the bump 54 of the conductive tube 5 will be removed from the cutout 701 of the conductive track 70.

Figure 8:
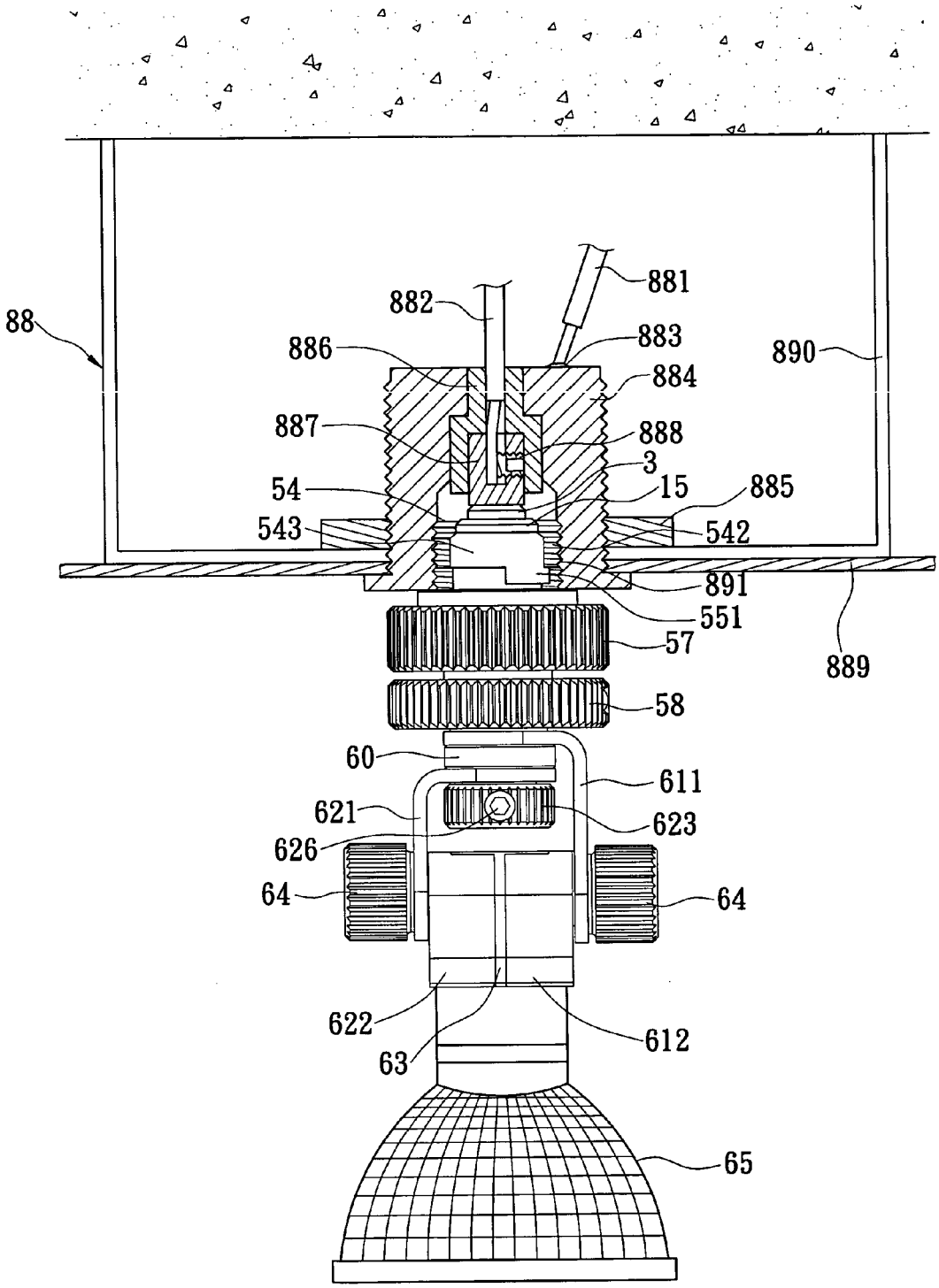
FIG. 8 is an enlarged cross-sectional view of the track light kit according to the present invention.

As illustrated in FIG. 8, the track adapter can be assembled in a light fixture 88 serving as a ceiling lamp or a recessed lamp. The light fixture 88 includes a first electrode cable 881, a second electrode cable 882, a solder 883, an outer conductive sleeve 884, a screw nut 885, an insulation member 886, an inner conductive sleeve 887, a screw 888, a panel 889 and a box 890. The outer conductive sleeve 884 has a screw thread 891 arranged therein. The insulation member 886 is disposed between the outer conductive sleeve 884 and the inner conductive sleeve 887. When the conductive tube 5 is rotated, the screw surface 542 of the bump 54 mates with the screw thread 891 for connection between the track light to the light fixture 88. The press-in member 3 will electrically connect the inner conductive sleeve 887 via the head end thereof.

The present invention uses a source of 12 voltages, which is less that the standard of 24 voltages to guarantee safety.

The present invention has the following characteristic advantages:

1. A single hand can manipulate the rotation of the secure structure easily.

2. The conductive tube and the first electrode assembly combine into a first electrical path; the press-in member, the resilient member, the mounting member and the second electrode assembly combine into a second electrical path. The source can be provided to the track light via the first electrical path and the second electrical path; thus the weight and volume of the track light can be reduced.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A track adapter, comprising:

an insulation tube having an upper opening and a lower opening formed in two opposing ends thereof;

a resilient member made of conductive materials and arranged in the insulation tube;

a press-in member made of conductive materials and having a tail end contacting a head end of the resilient member and restricted in the insulation tube;

a mounting member made of conductive materials and having a head end contacting a tail end of the resilient member, and being orientated in the insulation tube;

a conductive tube made of conductive materials and having an upper entrance and a lower entrance formed in two ends thereof, wherein the conductive tube includes a secure structure disposed on the upper entrance thereof, the insulation tube is disposed in the conductive tube, the press-in member has a head end exposed by the upper opening of the insulation tube and the upper entrance of the conductive tube, and the mounting member has a tail end exposed by the lower opening of the insulation tube and the lower entrance of the conductive tube; and a connection assembly including a first electrode assembly electrically connecting to the conductive tube and a second electrode assembly electrically connecting to the tail end of the mounting member and the connection assembly being on the lower side of the conductive tube and mounting member;

wherein the mounting member is formed in one-piece formation and has a long extending body extending downwardly;

wherein the first electrode assembly has at least one flat portion for a clamping connection on the conductive tube and the second electrode assembly has at least one flat portion for a clamping connection on the tail end of the mounting member.

2. The track adapter as claimed in claim 1, wherein the insulation tube has an interior flange formed thereon and adjacent to the upper opening thereof, the press-in member has an exterior flange formed thereon and adjacent to the tail end thereof, the exterior flange is exposed by the upper opening of the upper entrance of the conductive tube, and the press-in member is restricted in the insulation tube due to the interior flange of the insulation tube barricading the exterior flange of the press-in member.

3. The track adapter as claimed in claim 1, wherein the insulation tube has an exterior flange formed thereon and adjacent to the upper opening thereof, the exterior flange is exposed by the upper opening of the upper entrance of the conductive tube, and the exterior flange has an exterior diameter greater than an interior diameter of the upper entrance of the conductive tube.

4. A track adapter, comprising:

an insulation tube having an upper opening and a lower opening formed in two opposing ends thereof, the insulation tube having an upper portion and a lower portion, the lower portion having an inner diameter and an outer diameter less than those of the upper portion;

a resilient member made of conductive materials and arranged in the insulation tube;

a press-in member made of conductive materials and having a tail end contacting a head end of the resilient member and restricted in the insulation tube;

a mounting member made of conductive materials and having a head end contacting a tail end of the resilient member, and being orientated in the insulation tube; and a conductive tube made of conductive materials and having an upper entrance and a lower entrance formed in two ends thereof, wherein the conductive tube includes a secure structure disposed on the upper entrance thereof, the insulation tube is disposed in the conductive tube, the press-in member having a head end exposed by the upper opening of the insulation tube and the upper entrance of the conductive tube, and the mounting member having a tail end exposed by the lower opening of the insulation tube and the lower entrance of the conductive tube, the conductive tube having a top portion and a bottom portion, the bottom portion having an inner diameter less than that of the top portion, and the upper portion of the insulation tube mates with the top portion of the conductive tube accordingly; and a connection assembly including a first electrode assembly electrically connecting to the conductive tube and a second electrode assembly electrically connecting the tail end of the mounting member.

5. The track adapter as claimed in claim 4, wherein the secure structure is a bump projecting therefrom, the bump has a contact surface opposing the upper entrance of the conductive tube, and the conductive tube includes a baffle portion connecting the contact surface.

6. The track adapter as claimed in claim 5, wherein the bump has two screw surfaces opposing each other and two flat surfaces opposing each other formed outwardly, the two screw surfaces are separated from each other by a distance, greater than that separating the two flat surfaces, the baffle portion has two strengthening surfaces opposing each other, two rounded surfaces opposing each other, two baffle surfaces opposing each other, wherein the two strengthening surfaces and the two flat surfaces are coplanar, respectively, the two baffle surfaces are adjacent to the contact surface, and the rounded surfaces are adjacent to the contact surface and located between the two baffle surfaces and the two strengthening surfaces, respectively.

7. The track adapter as claimed in claim 4, wherein the secure structure is a bump having a screw arranged outside thereof.

8. The track adapter as claimed in claim 4, further including a secure member, a rotation member and a connection member, wherein the conductive tube includes a screw thread arranged thereon, the secure member and the rotation member are screwed onto the conductive tube via the screw, and the connection member penetrates through to orientate the rotation member in the conductive tube.

9. The track adapter as claimed in claim 4, wherein the mounting member has a screw thread arranged on the tail end thereof, the second electrode assembly includes a screw nut mating with the screw thread and a fastening member penetrating therethrough to orientate the screw nut in the mounting member.

10. The track adapter as claimed in claim 9, wherein the first electrode assembly includes a first arm made conductive materials and having an upper through hole formed thereon, the second electrode assembly includes a second arm made conductive materials and having a top through hole formed thereon, the connection assembly further includes an insulation sheet, and the tail end of the mounting member penetrates through the upper through hole of the first arm, the insulation sheet and the top through hole of the second arm to screw into the screw nut of the second electrode assembly.

11. The track adapter as claimed in claim 10, wherein the first arm has a lower through hole, the second has a bottom through hole, the connection assembly further includes an insulation post and two screw nuts, the first electrode assembly includes a first junction made of conductive materials and connecting to an end of the insulation post, the second electrode assembly includes a second conjunction made of conductive materials connecting to an opposing end of the insulation post, the lower through hole of the first arm and the bottom through hole of the second arm accommodate two ends of the insulation post, respectively, and contact the first conjunction and the second conjunction respectively, the two screw nuts screw onto the two ends of the insulation post and outside the first arm and the second arm, respectively.

12. A track light kit, comprising:

a track assembly and a track adapter;

wherein the track assembly includes;

a conductive track having a cutout and a clasp structure disposed on an inner wall thereof;

an insulation strip arranged in the conductive track, and having an opening relating to the cutout; and a conductive strip arranged in the insulation strip and exposed by the cutout; and wherein the track adapter includes:

an insulation tube having an upper opening and a lower opening formed therein;

a resilient member made of conductive materials and arranged in the insulation tube;

a press-in member made of conductive materials, having a tail end contacting a head end of the resilient member, and constricted in the insulation tube;

a mounting member made of conductive materials, having a head end contacting a tail end of the resilient member for orientation in the insulation tube;

a conductive tube made of conductive materials, and having an upper entrance, a lower entrance and a secure structure arranged on the upper entrance, wherein the insulation tube is disposed in the conductive tube, the press-in member has a head end exposed by the upper opening of the insulation tube and the upper entrance of the conductive tube, and the mounting member has a tail end exposed by the lower opening of the insulation tube and the lower entrance of the conductive tube; and a connection assembly including a first electrode assembly electrically connecting to the conductive tube and a second electrode assembly electrically connecting to the tail end of the mounting member, the connection assembly being on the lower side of the conductive tube and mounting member;

wherein the head end of the press-in member electrically connects the conductive tube to the conductive strip of the track assembly via the cutout of the conductive track and the opening of the insulation strip, the secure structure of the conductive tube engages with the clasp structure of the conductive track, and the conductive tube electrically connects the conductive track;

wherein the mounting member is formed in one-piece formation and having a long extending body extending downwardly;

wherein the first electrode assembly has at least one flat portion for a clamping connection on the conductive tube and the second electrode assembly has at least one flat portion for a clamping connection on the tail end of the mounting member.

* * * * *